United States Patent [19]

Kagawa

[11] Patent Number: 4,723,560

[45] Date of Patent: Feb. 9, 1988

[54] SYSTEM FOR CONTROLLING LAMINA SIZE IN RAW MATERIAL TREATMENT PROCESS FOR TOBACCO LEAVES

[75] Inventor: Kenichi Kagawa, Hiratsuka, Japan

[73] Assignee: The Japan Tobacco & Salt Public Corp., Tokyo, Japan

[21] Appl. No.: 632,579

[22] Filed: Jul. 20, 1984

[30] Foreign Application Priority Data

Jul. 21, 1984 [JP] Japan ..... 58-131979

[51] Int. Cl.[4] ..... A24B 5/06; A24B 5/08; A24B 5/16

[52] U.S. Cl. ..... 131/313; 131/319; 131/320; 131/303; 131/312

[58] Field of Search ..... 131/302, 312, 303, 313, 131/322, 319, 320

[56] References Cited

U.S. PATENT DOCUMENTS 2,771,079 11/1956 Umney ..... 131/313
3,410,280 11/1968 Wochnowski ..... 131/313
3,715,083 2/1973 Funk ..... 131/24

FOREIGN PATENT DOCUMENTS 1632152 9/1969 Fed. Rep. of Germany .
2249800 4/1973 Fed. Rep. of Germany .
1549705 12/1967 France .
719106 11/1954 United Kingdom .

*Primary Examiner*—V. Millin
*Attorney, Agent, or Firm*—Armstrong, Nikaido, Marmelstein & Kubovcik

[57] ABSTRACT

A system for controlling the lamina size in a raw material treatment process for tobacco leaves comprising measuring means for measuring the production rate of the laminae larger than a given size in the raw material treatment process in which the tobacco leaves which have been provided with a water content and temperature by a humidity controller are stripped into laminae and ribs by means of rib removing machines capable of changing a mechanical impact force applied upon the tobacco leaves by changing the rotational number of grid or threshing gear and are then separated by means of separating machines, and operational control means for receiving measurement signals from said measuring means as a feedback signal for searching a water content, temperature and rotational number of grid or threshing gear which minimize the production rate of the laminae not larger than a given size by a hill-climb method using the water content and temperature provided by the humidity controller and the rotational number of grid or threshing gear as manipulation factors.

2 Claims, 9 Drawing Figures

SYSTEM FOR CONTROLLING LAMINA SIZE IN RAW MATERIAL TREATMENT PROCESS FOR TOBACCO LEAVES

BACKGROUND OF THE INVENTION

The present invention relates to a system for controlling the lamina size in a raw material treatment process for tobacco leaves.

In general tobacco production process, tobacco leaves raw materials are separated each other and then are provided with a flexibility by the addition of water and steam from a humidity controller. Thereafter they are stripped into parenchyma (hereafter referred to as laminae) and veins (hereafter referred to as ribs) and separated into the laminae and ribs by separating machines. The luminae are dried to possess 12% of water content for avoiding change in quality and molding during a long term storage and then packed in a barrel or other container (abovementioned process be referred to as a raw material treatment process). The packed laminae are stored for a long time for maturing. The laminae which have finished maturing are threshed into cut cigarette after the steps of leaf orientation, blending and flavoring.

During the raw material treatment process, the tobacco leaves are stripped into laminae and ribs. The degree of this stripping gives a large influence upon a raw material yield and product quality. That is, the tobacco leaves are subjected to a great mechanical action when they are stripped into laminae and ribs. Accordingly insufficient separation between laminae and ribs is accomplished, or conversely excessive separation is accomplished so that the tobacco leaves are finely divided depending upon the physical properties possessed by the tobacco leaves. The physical properties depend largely on the water content and temperature.

Accordingly, it is important to control the factors which give influence upon the quality, that is, the water content and temperature of the tobacco leaves supplied to rib removing machines so that they are suitable for the tobacco leaves and to control the mechanical impact force upon the tobacco leaves in the rib removing machines to a suitable value for the tobacco leaves.

These controls have heretofore been manually carried out. This manual technique includes adjusting the water content and temperature of the tobacco leaves supplied to the rib removing machines to suitable values by controlling control valves of water and steam of the humidity controller in accordance with a predetermined preset manipulation condition table and adjusting the mechanical impact force given to the tobacco leaves in rib removing machines by replacing a basket with that having a different pitch of grid.

It is however very difficult to manually control the quality of the tobacco leaves while suppressing the production of the laminae not larger than a given size since preliminary determination of the water content and temperature suitable for rib removal and the mechanical impact force applied to the tobacco leaves in the rib removing machine is time and man power consuming due to the fact that the specific physical properties of the tobacco leaves largely varies with the production place, weather conditions of the production year and the like and since it is practically impossible to replace the basket of the rib removing machine depending upon the character of the tobacco leaves which constantly changes.

SUMMARY OF THE INVENTION

It is therefore an object of the present invention to provide a novel system for controlling the lamina size in a raw material treatment process for tobacco leaves, which is capable of decreasing the production of the lamina not larger than a given size as low as possible.

In accordance with the present invention, there is provided a system for controlling the lamina size in a raw material treatment process for tobacco leaves comprising measuring means for measuring the production rate of the laminae larger than a given size in the raw material treatment process in which the tobacco leaves which have been provided with a water content and temperature by a humidity controller are stripped into laminae and ribs by means of rib removing machines capable of changing a mechanical impact force applied upon the tobacco leaves by changing the rotational number of grid or threshing gear and are then separated by means of separating machines; and operational control means for receiving measurement signals from said measuring means as a feedback signal for searching a water content, temperature and rotational number of grid or threshing gear which minimize the production rate of the laminae not larger than a given size by a hill-climb method using the water content and temperature provided by the humidity controller and the rotational number of grid or threshing gear as manipulation factors.

DETAILED DESCRIPTION OF THE EMBODIMENTS

The present invention will be described by way of an embodiment with reference to the drawings.

Figure 1:
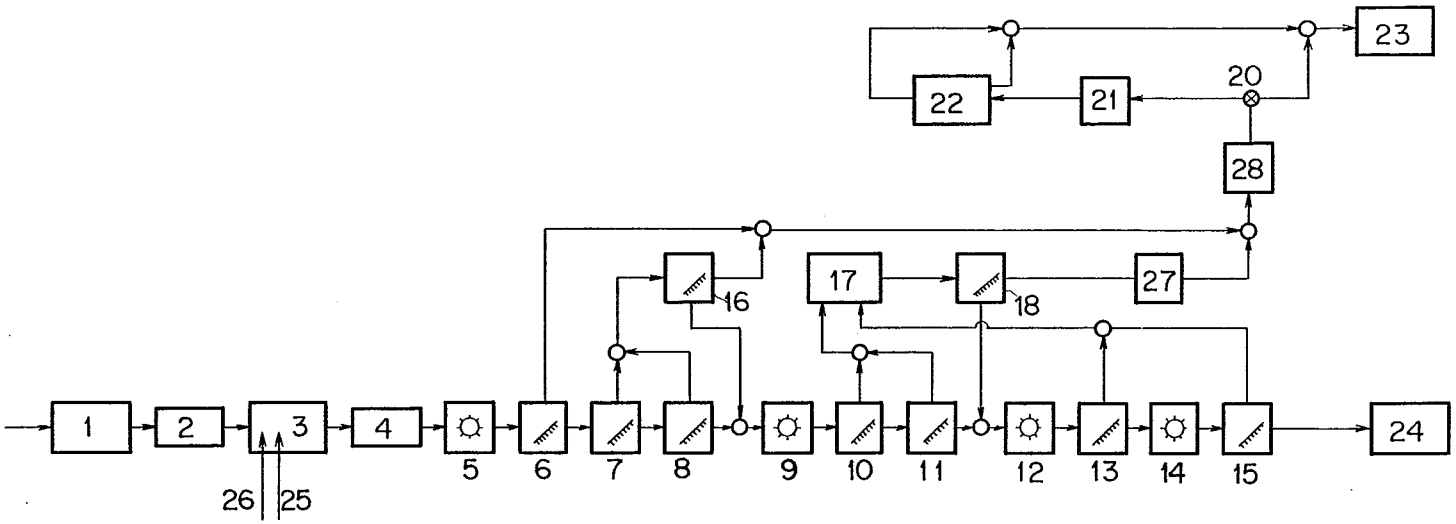
FIG. 1 is a block diagram showing a whole process for treating tobacco leaves.

Referring now to FIG. 1, there is shown a process for treating raw material of tobacco. The tobacco leaves supplied from a supplier 1 are controlled by a flow rate controller 2 so that they are conveyed at a predetermined flow rate and then are supplied to a humidity controller 3. In the humidity controller the tobacco leaves are provided with a flexibility necessary for rib removal by addition of water and steam which is sprayed from water and steam nozzles 25 and 26 respectively. The tobacco leaves which have finished humidity control are separated into laminae and ribs by means of rib removing machines 5, 9, 12 and 14 and furthermore separated by separating machines 6, 7, 8, 10, 11, 13, 15, 16 and 18.

In FIG. 1 reference numerals 4 and 21 represent feeders; 17 a conveyer assembly; 20 a sampler; 22 a device for measuring the size of laminae; 23 and 24 silos; 27 and 28 weight meters for measuring the flow rate of laminae.

Figure 2:
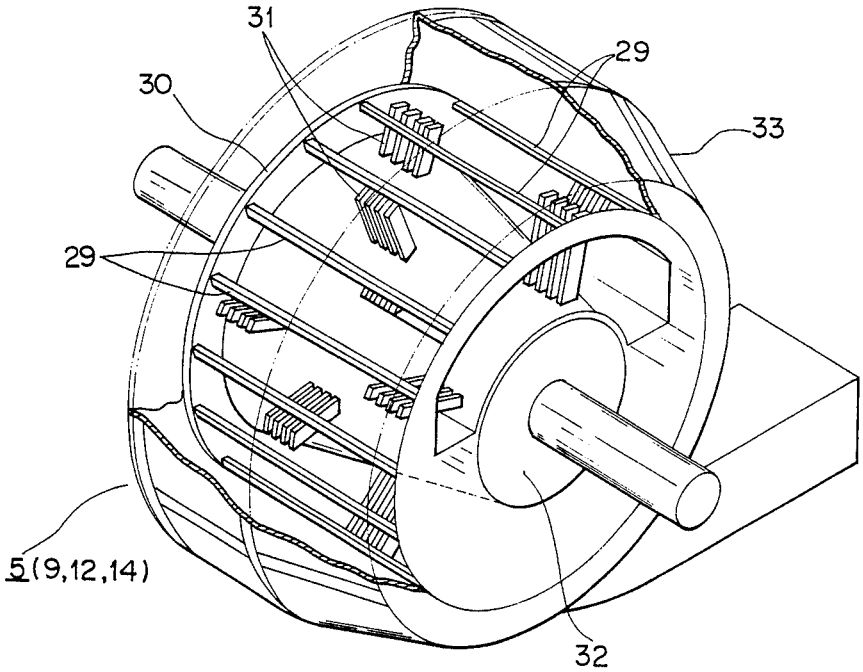
FIG. 2 is a partly cutaway perspective view showing a rotary rib removing machine.

Each of the aforementioned rib removing machines 5, 9, 12 and 14 comprise a cylindrical grid member 30 having grids 29 disposed at given intervals therein, a truncated core member 32 within the grid member 30 having a plurality of threshing gears 31 disposed on the outer periphery thereof and a casing which encloses the grid member 30 as shown in FIG. 2. When the tobacco leaves are charged into a spacing between the grid member 30 and the core member during the rotation of the grid member 30, a mechanical impact force acts upon the tobacco leaves from the grids 29 and threshing gears 31. The tobacco leaves are separated into the laminae and the ribs when they come out from the space between grids 29 and enter into the space between the grid member 30 and the casing 33.

The rib removing machines 5, 9, 12 and 14 are capable of changing the mechanical impact force acting upon the tobacco leaves by changing the rotational number of the grid member 30 (the grid rotational number) and/or relative grid pitch (relative spacing between the grids 29 and the threshing gears 31). In other words, the threshing rate can be adjusted by changing the grid rotational number and/or relative grid pitch (refer to FIG. 3). A term threshing rate herein means a value which is obtained by multiplying the ratio of the laminae produced by the first rib remover 5 to the total laminae (lamina production ratio) with a constant determined by the separating machines. For example, 75 per cent of threshing rate means that 75 percent of the total lamina is stripped by the first rib removing machine 5.

The grid member 30 may be secured and the core member 32 may be rotated. In this case, the threshing rate is changed by changing the rotational number of the core member 32 (threshing gear rotational member).

Figure 4:
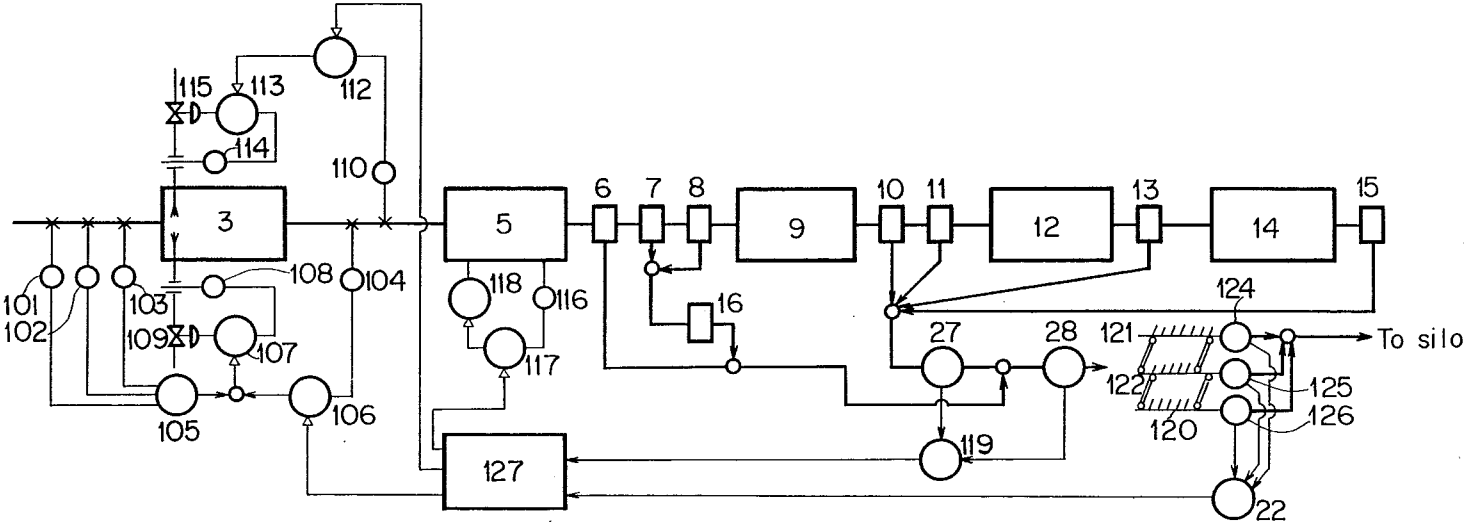
FIG. 4 is a block diagram showing an example of a control system of the present invention.

Referring to FIG. 4, there is shown an embodiment of the control system of the present invention. Detectors 101, 102 and 103 for detecting the water content, temperature and flow rate of the tobacco leaves respectively are disposed at the entrance of the humidity controller 3. The water content, temperature, and flow rate of the tobacco leaves conveyed to the humidity controller 3 are measured so that the measurements are applied to an operational device 105. The operational device 105 calculates the amount of water to be added upon the basis of the measurement and a preset value of the water content given to the tobacco leaves, which is stored in a PiD adjuster 106. The calculated value is a cascade preset value for a PiD adjuster 107.

On the other hand, a detector 104 for detecting the water content is disposed at the exit of the humidity controller 3 so that the water content of the tobacco leaves which have been provided with water is measured and the measurement is applied to the PiD adjuster 106 as a feedback signal.

The PiD adjuster 106 which stores a preset value of the water content given to the tobacco leaves compares the preset value with the measured value, carries out PiD compensation and provides a signal when there is a deviation therebetween. The output signal is added to the signal (calculated value) of the aforementioned operational device 105 so that the cascade preset value of the PiD adjuster 107 is corrected.

The water nozzle 25 is provided with a control valve 109 which is controlled by an output signal from the PiD adjuster 107. The amount of water which is controlled by the control valve 109 is measured by the flow rate detector 108. When there is a deviation between the measured value and cascade preset value the PiD compensation is carried out by the PiD adjuster 107.

A temperature detector 110 as well as the water content detector 104 is disposed at the exit of the humidity controller 3. The temperature of the tobacco leaves discharged from the humidity controller 3 is measured. The measurement is applied to a PiD adjuster 112 as a feed back signal.

The preset value representative of the temperature imparted to the tobacco leaves is stored in the PiD adjustor 112 where the preset value is compared with the measurement. If there is a deviation therebetween the PiD adjustor PiD compensates for the deviation and outputs a signal. The output signal provides a cascade preset value for the PiD adjustor 113 which controls the control valve 115 disposed at the steam nozzle 26. The flow rate of the steam which is controlled by the control valve 115 is measured by the flow rate detecting portion 114. If there is a deviation between the measurement and the cascade preset value, PiD compensation for the deviation is accomplished by the PiD adjustor 113.

The rotational number of the grid of the first rib removing machine 5 is measured by a rotary meter 116. The measurement is input to a PiD adjustor 117.

An optional rotation number of the grid necessary for rib removing is stored in the PiD adjustor 117. If there is a deviation between the preset value and the measurement, the PiD adjustor then PiD compensates for the deviation and outputs a signal to a rotational number controlling motor 118.

The laminae which have been stripped from the tobacco leaves in the rib removing machine 5, 9, 12 and 14 are separated from the ribs by the rib removing machines 6, 7, 8, 10, 11, 13, 15, 16, 18 and then fed to a vibration type sifter 120. The vibration type sifter 120 comprises two sifters 121 and 122 having different meshes which are stacked. For example, the laminae not less than 25 mm are sifted by the sifter 121 and 13–25 mm laminae are sifted by the sifter 122. The flow rate of the laminae which are sifted by the sifters 121 and 122 is measured by a measuring devices 124, 125 and 126. The measurements are input to a lamina size meter 22 in which the rate of production of the laminae not larger than 13 mm is calculated.

The calculated value from the lamina size meter 22 is input as a feedback signal to an operational control device 127 in which an optimum value which is to be preset in the PiD adjustors 106, 112, 117 is calculated upon the basis of the feedback signal.

Before the detailed description of the operation of the operational controller 127, the relation between the tobacco leaves charged into the rib removing machines 5, 9, 12, 14 and the production rate of laminae not larger than 13 mm and the relation between the threshing rate of the first rib removing machine 5 and the production rate of, the laminae not larger than 13 mm are described with reference to FIGS. 5 and 6 respectively.

Figure 5:
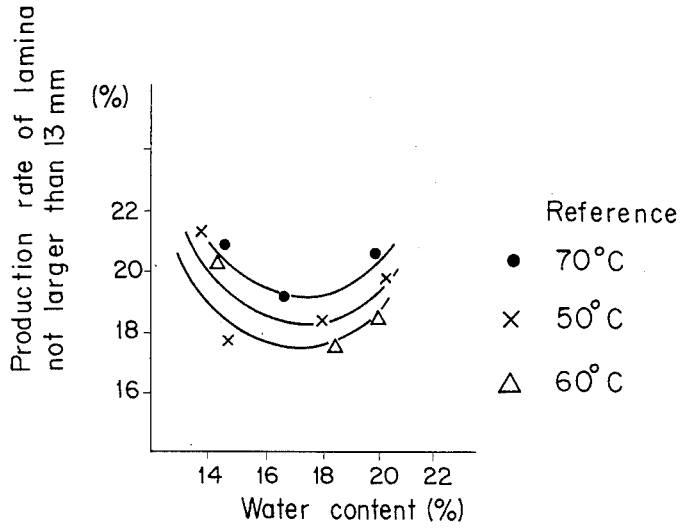

Referring to FIG. 5, the production rate of the laminae not larger than 13 mm varies according to a parabolic curve. In this case, the production rate of the laminae not larger than 13 mm is minimal at a humidity of about 17%. The relation between the temperature and the production rate of laminae not larger than 13 mm shows the same tendency. The production rate of the laminae larger than 13 mm is minimal at temperature of 60° C.

Figure 6:
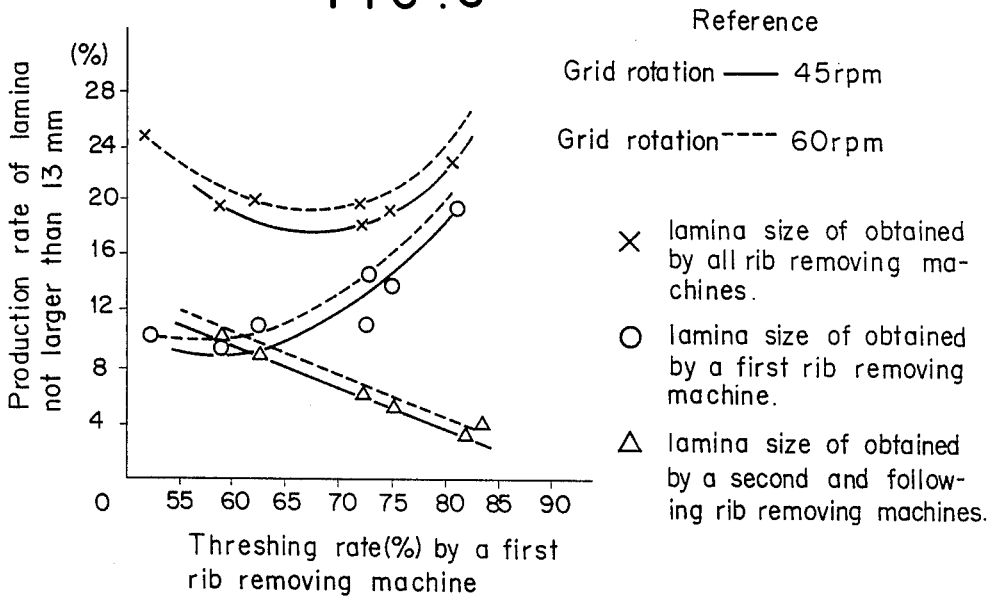
FIGS. 5 and 6 are graphs showing quality characteristics.

Referring to FIG. 6, when the threshing rate of the first rib removing machine 5 is increased the production rate of the laminae not larger than 13 mm in the rib removing machine 5 is increased, the production rate of the laminae not larger than 13 mm in the rib removing machine 5 is increased, but the load imposed upon the second and following removing machines 9, 12, 14 is decreased so that the laminae not larger than 13 mm produced in the rib removing machine 9, 12 and 14 is decreased. Accordingly when the threshing rate of the first rib removing machine 5 is increased the laminae not larger than from all the rib removing machines 5, 9, 12, and 14 varies according to a parabolic curve. In this case, when the threshing rate of the first rib removing machine 5 is 75%, the production rate of the laminae not larger than 13 mm from all the removing machines 5, 9, 12, and 14 is minimal.

Since the relations change according to the production place, weather conditions, physical properties, etc. the operational controller 127 searches optimum values for the water content, temperature, grid rotational number to be preset to the PiD adjustors 106, 112 and 117 respectively by a symplex method one of hill-climb methods which determine the optimal manipulation conditions upon the basis of feed back signal (production rate of laminae not larger than 13 mm) from the lamina size measuring device 22.

Figure 7:
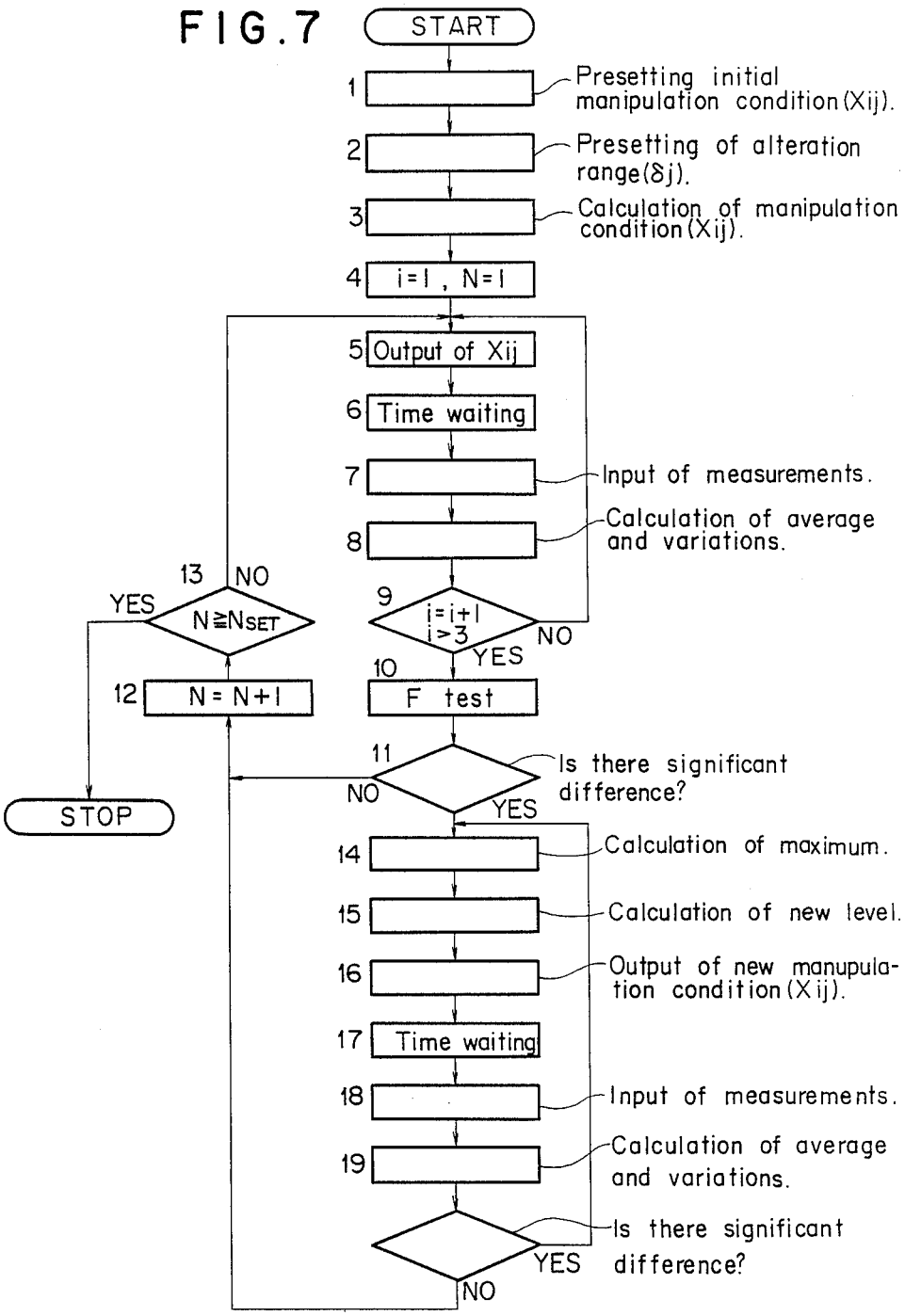
FIG. 7 is a flow chart illustrating the operation of an operational control device.
Figure 9:
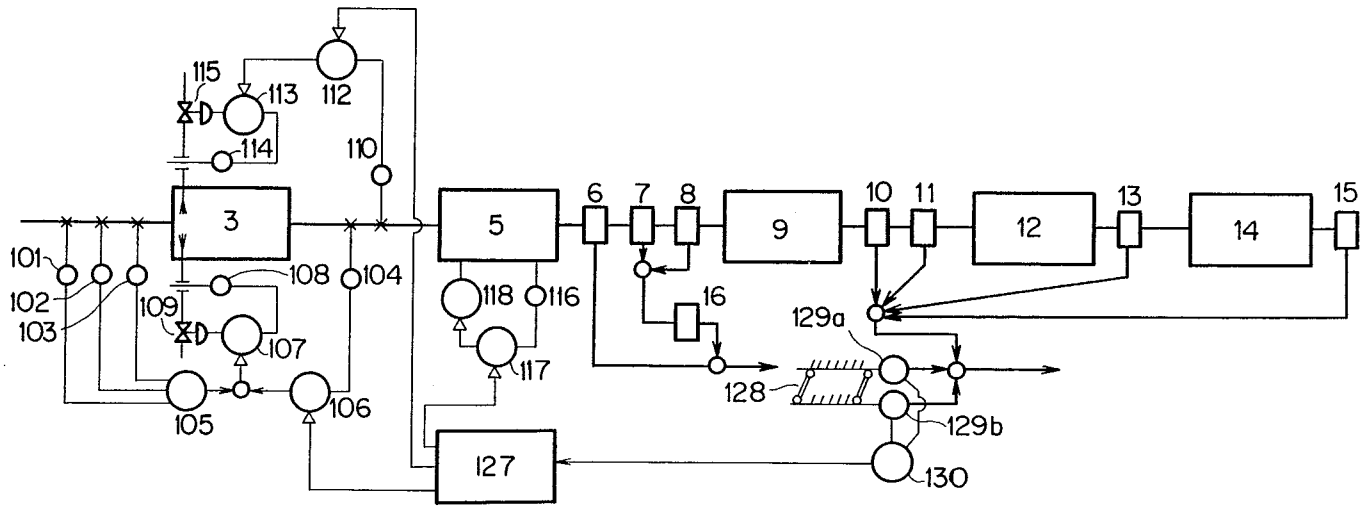
FIG. 9 is a block diagram showing another embodiment of the control system of the present invention.

FIG. 7 is a flow chart showing the operation of the operational controller 127. In accordance with the FIG. 7 the manipulating conditions $X_{ij}$ (water content, temperature, grid rotational number) which are determined optimum from the past operation conditions are preset in step 1. At this time, the levels are combined not to intersect the results.

Figure 3:
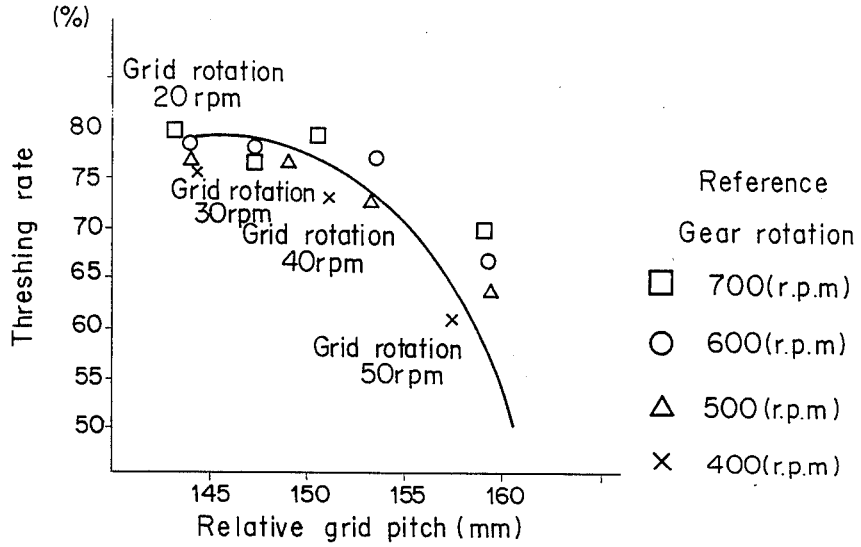
FIG. 3 is a graph showing quality characteristics.

The variation range ($\delta_j$) of the manipulation condition taken from the graphs of FIGS. 3, 5, 6 and 8 which gives no extremely adverse influence to the operation conditions as determined from FIGS. 3, 5 and 6, is preset in step 2. The other manipulating conditions, such as optimum manipulation condition, are calculated in step 3 in accordance with the following formula.

$$X_{ij}=X_{ij}\pm\delta_j$$

wherein i represents a level ($i=1\sim3$), j represents a manipulation factor ($j=1\sim3$) $j=1$ represents a humidity, $j=2$ represents a temperature $j=3$ represents a grid rotational number.

The level 1 is preset in next step 4 to carry out the experiments from level 1 to level 3. Manipulation condition ($X_{ij}$) in step 5 is fed to PiD adjustors 106, 112, 117. The lamina size measuring device 22 waits the time until the response of the step 5 happens and the lapsed time is obtained in step 6. After the passage of such lapsed time, the measurement is input from the lamina size measuring device 22 into step 7 (the sampling interval of the measurements is one second and the number of samplings is 180). Average value and variations are calculated upon the basis of the measurements in step 8. The steps 5 to 8 are repeated in step 9 a second third time. Significant test (F test) of the results after steps 5 to 8 have been repeated three times is carried out in step 10 by a statistic approach. Discrimination whether or not there is a significant difference among the averaged values is carried out in step 11. If these is a significant difference the program will go to next step 14. If there is not any significant difference it will go to next step 12.

Number one is added in step 12 to the number of the times (N) and steps 4 to 8 are repeated. The resultant number of experiments (N+1) is then compared with the preliminarily number of repeats preset step 13. When the number (N+1) is smaller than the preset number of experiments, the experiment is repeated from the step 1 (the steps 5 to 8 is executed so as to levels 1, 2 and 3). In this case, past data graphs of FIGS. 3, 5, 6 and 8 is used again to carry out a static test. On the other hand the system is stopped when the number (N+1) exceeds the preset number of repeats experiments. Thereafter a maximum is determined from the average values of the level 3 (the average value under a manipulation condition which gives the most adverse response) in step 14. The manipulation condition which gives the most adverse response is omitted and a new level is calculated in accordance with a following formula in step 15.

$$X_i=(1+\alpha)X_i-X_i\,mm$$

wherein $X_i$ is a new manipulation condition of i factor;

$X_i$ is an average of the manipulation condition of the factor i of the lost time except for the manipulation condition giving the most adverse response;

$x_i$ mm is the manipulation condition giving the most adverse response of the factor of the lost time; and $\alpha$ is a constant.

New manipulation conditions are preset into the PiD adjustors 106, 112 and 117 in step 16. The lamina size measuring device 22 waits the time until the response of the step 16 happens and the lapsed time obtained in step 17. After the passage of lapsed time, the measurement is input from the lamina size measuring device 22 in step 18 (the sampling interval of the measurements is one second and the number of samplings is 180). Average value and variations are calculated upon the basis of the measurements in step 19. Significant test is then carried out by using the results of the repeats at this time and the result of repeats of the aforementioned level 2 in step 20. The program will go back to the step 14 if there is a difference. It will go back to the step 12 if there is no difference.

Figure 8:
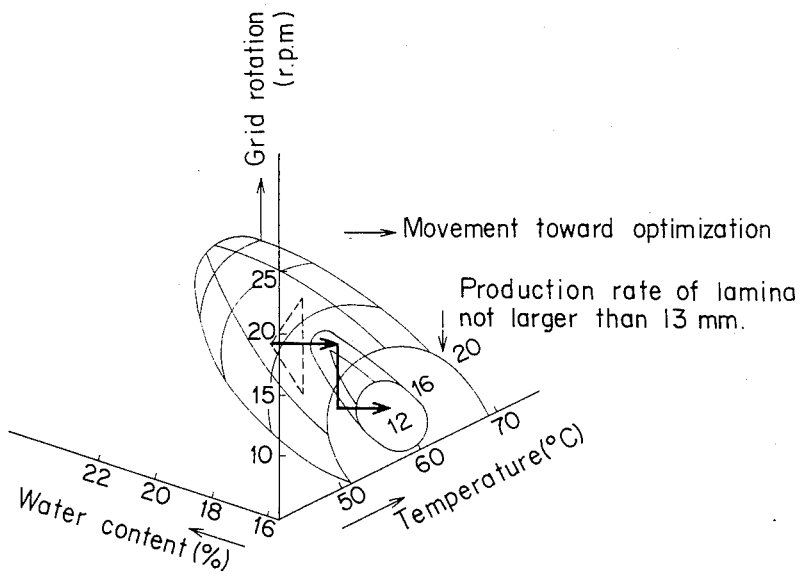
FIG. 8 is an explanatory view of symplex method.

Stripping the laminae is repeated each time when changing the preset values which are to be preset to the PiD adjustors 106, 112 and 117 so that the preset value minimizes the production rate of the laminae not larger than 13 mm (refer to FIG. 8).

When the optimum values of the water content, temperature, and mechanical impact force to be applied are determined by the operational device 127 and preset to the PiD adjustors 106, 112 and 117 and the tobacco leaves are stripped into laminae and ribs, the production rate of laminae not larger than 13 mm may be lowered, by about 2% compared with the conventional method using man power.

Since the production rate of the laminae not larger than 13 mm is determined from the laminae stripped by all rib removing machines 5, 9, 12 and 14, the response is low while the convergence to an optimal point is fast. Therefore in order to make the response high, the production rate of the laminae not larger than 13 mm is determined from the laminae stripped by the rib removing machine 5. That is, the laminae which have been stripped by the rib removing machine 5 is fed to the sifter 128 in which the laminae not larger than 13 mm are sifted and the flow rate of the sifted laminae is measured by means of weight meters 129*a* and 129*b*. Upon basis of the measurements the production rate of the laminae not larger than 13 mm is measured by a lamina size metering device 130. In this case, the production rate of the laminae not larger than 13 mm at the all rib removers 5, 9, 12 and 14 is inversely increased as shown in FIG. 6 even if the production rate of the laminae not larger than 13 mm is lowered by reducing the threshing rate at the first rib removing machine 5. Therefore the final target value of the production rate of the laminae not larger than 13 mm is preset in the operational device 127. The water content, temperature and grid rotational number is searched to approach the final target value.

The aforementioned operational device 127 receives a signal from the operational device 131 as a feedback signal and has a function of retrieving the optimal values such as water content, temperature and grid rotational number. The operational device 131 receives the result of measurement of the weight meter 27 (the flow rate of the laminae stripped by the second and subsequent rib removing machines 9, 12, and 14) and the result of measurement of the weight meter 28 (the flow rate of the laminae stripped by all the rib removing machines 5, 9, 12 and 14) and calculates the ratio of the flow rate of the laminae stripped by all rib removing machines to the flow rate of the laminae stripped by the first rib removing machine 5 (the production ratio of laminae).

In the aforementioned embodiment, the operational device 127 which determines the optimum value in accordance with the symplex method is used. However an operational device which determines the optimal value in accordance with evop method may be used.

There is shown the case in which the production rate of the laminae not larger than 13 mm is measured by the lamina size measuring devices 22 and 130. The present invention is not limited to such numerical value. The main object is to measure the production rate of the laminae which gives adverse influence upon the quality in the subsequent steps.

The present invention includes means for measuring a production rate of the laminae not larger than predetermined size and means for retrieving a water content, temperature and mechanical impact force applied which minimize the production rate of laminae not larger than a predetermined size by a hill-climb method using water content and temperature imparted to the humidity controller and mechanical impact force as manipulating factors, said retrieving means being adapted to receive the result of measurement of the former measuring means. Therefore the quality control is possible while decreasing the production rate of the laminae not larger than a predetermined size as low as possible.

Furthermore the production rate of the laminae not larger than a given size (13 mm) may be lowered in comparison with that obtained by the conventional method.

What is claimed is:

1. In a raw material treatment process for tobacco where tobacco leaves raw material are separated into laminae and ribs by a plurality of separating machines after the leaves are given a water content and temperature by a humidity controller and the laminae are threshed from the leaves by a plurality of rotary rib moving machines having variable physical impact force to the leaves by changing the revolution of grid of threshing gear; a method for controlling a raw material treatment process for tobacco leaves comprising the steps of (1) setting a set of preferable operating conditions each including levels concerning the water content, the temperature of the humidity controller and revolution of a first rotary rib removing machine for which preferable value of the levels are determined from a past experience of operation, and computing further two sets of operating conditions above and below said preferable operating condition by modifying said levels;

(2) threshing tobacco leaves by having the first through nth rotary rib removing machines operated at each set of operating conditions to produce laminae separated from the tobacco leaves, and weighing an amount of said separated laminae and an amount of laminae contained therein with unacceptable sizes less than a predetermined value respectively;

(3) computing a ratio of the laminate with unacceptable size less than the predetermined value to the said separated laminae at each set of operating conditions from the amount of the laminae separated by the first through nth rotary rib removing machines and the amount of the laminae with unacceptable size less than the predetermined value contained in said separated laminate;

(4) dropping the set of operating conditions which yields the largest ratio of the laminae with unacceptable sizes upon judgment based on the ratio of the laminae with unacceptable size less than the predetermined value contained in said separated laminae corresponding to each set of operating conditions, and computing new values of the levels concerning the water content, the temperature of said humidity controller and the resolution of said first rotary rib removing machine through a predetermined mathematical operation to obtain a new set of operating conditions which is to be newly set for the humidity controller and the first rotary rib removing machine respectively and outputting said new set of operating conditions to the humidity controller and to the first rotary rib removing machine;

(5) threshing the tobacco leaves by having the first through nth rotary rib removing machines operated at said new set of operating conditions to produce laminae separated from tobacco leaves, and weighing the amount of said separated laminae and the amount of the laminae contained therein with unacceptable size less than the predetermined value respectively;

(6) computing a ratio of the laminae with unacceptable size less than the predetermined value to the said separated laminate at said new set of operating conditions;

(7) dropping the set of operating conditions which yields the largest ratio of the laminae of unacceptable size upon judgment based on the ratio of the laminae with unacceptable size less than the predetermined value contained in said separated laminae corresponding to each of said new set of operating conditions and remaining previous two sets of operating conditions, and computing new values of the levels concerning the water content, the temperature of sid humidity controller and the revolution of said first rotary rib removing machine through said predetermined mathematical operation to obtain a further new set of operating conditions which is to be newly set for the humidity controller and the first rotary rib removing machine respectively and outputting said further new set of operating conditions for the humidity controller and the first rotary rib removing machine; and (8) repeating the steps (6) and (7) in sequence until no significant difference is observed in the ratio of the laminae with unacceptable size less than the predetermined value to the said separated laminae among the remaining previous two sets of operating conditions and said further new set of operating conditions.

2. A method for controlling a raw material treatment process for tobacco leaves according to claim 1, wherein said nth rotary rib removing machine is the final rib removing machine.

* * * * *